US005579611A

United States Patent [19]

Buckenmaier et al.

[11] Patent Number: 5,579,611

[45] **Date of Patent: *Dec. 3, 1996**

[54] ROOF WATER DISPERSAL SYSTEM

[75] Inventors: Erwine T. Buckenmaier, Westport; Richard J. Urban, Weston, both of Conn.

[73] Assignee: Savetime Corporation, Bridgeport, Conn.

[ * ] Notice: The term of this patent shall not extend beyond the expiration date of Pat. No. 5,261,195.

[21] Appl. No.: 339,974

[22] Filed: Nov. 15, 1994

[51] Int. Cl.[6] ..... E04D 13/064

[52] U.S. Cl. ..... 52/12; 52/11; 52/14; 52/15

[58] Field of Search ..... 52/11, 12, 13, 52/14, 15, 16; 210/474, 153, 154, 162

[56] References Cited

U.S. PATENT DOCUMENTS

| | | | |
|---|---|---|---|
| 3,939,616 | 2/1976 | Schapker | 52/94 |
| 4,646,488 | 3/1987 | Burns | 52/12 X |
| 5,251,410 | 10/1993 | Carey | 52/12 |
| 5,261,195 | 11/1993 | Buckenmaier et al. | 52/12 X |
| 5,261,196 | 11/1993 | Buckenmaier et al. | 52/12 X |

*Primary Examiner*—Carl D. Friedman

*Assistant Examiner*—W. Glenn Edwards

*Attorney, Agent, or Firm*—Mark P. Stone

[57] ABSTRACT

A roof water dispersal system includes a plurality of longitudinally extending dispersal elements mounted near the edge of a roof structure for receiving and dispersing streams of roof run-off water. The dispersal elements are spaced apart from each other and assembled into a unit mounted to receive the streams of run-off roof water, and the individual elements within the overall assembly can vary in shape, thickness or material to provide an optimal balance between dispersal efficiency and strength of the overall assembly. The dispersal elements of the assembly are supported by transverse elements which maintain the dispersal elements in predetermined relative positions within the assembly and mount the overall assembly relative to the edge of the roof structure. The system of the present invention includes transverse supporting elements which are positioned above the longitudinally extending dispersal elements. A further feature includes lateral barrier elements mounted along the longitudinally dispersal elements and spaced a predetermined distance apart from each other to control lateral flow of water received by the dispersal elements. The improvements provided by the top-suspended rain dispersal assembly increase the efficiency of the roof-water dispersion operation and reduce ground erosion beneath the dispersal assembly.

20 Claims, 2 Drawing Sheets

ROOF WATER DISPERSAL SYSTEM

BACKGROUND OF THE INVENTION

The present invention is generally directed to roof water dispersal systems such as those generally disclosed in U.S. Pat. No. 3,939,616 entitled "Rain Water Run-Off Disperser" issued on Feb. 24, 1976 to Richard L. Schapker, and U.S. Pat. No. 4,646,488 entitled "Rain Disperser System" issued to Lawrence C. Burns on Mar. 3, 1987. The disclosures of the aforementioned two United States patents are expressly incorporated by reference in the present specification.

U.S. Pat. Nos. 5,261,195 and 5,261,196, both of which are entitled "Roof Water Dispersal System" and both of which issued on Nov. 16, 1993 to the present inventors Erwine T. Buckenmaier and Richard J. Urban, disclose and claim improvements to roof water dispersal systems of the type generally disclosed by U.S. Pat. Nos. 3,939,616 and 4,646,488. The disclosures of both U.S. Pat. Nos. 5,261,195 and 5,261,196 are also expressly incorporated by reference in the present specification.

Prior art roof water dispersal systems, such as those disclosed by U.S. Pat. Nos. 3,939,616 and 4,646,488, include a plurality of longitudinal dispersal elements or slats which are oriented to extend laterally in a direction parallel to the drip edge of a roof structure. The prior art roof water dispersal assemblies include one or more transverse cross members which intersect and support the lateral slats from below in a substantially perpendicular orientation for assembling the slats into a unit and for maintaining a predetermined angular orientation and spacing between the individual lateral slats. The assembled unit is mounted either to the roof structure itself or to a vertical wall of a building structure such that the plurality of laterally extending parallel slats are positioned relative to the drip edge of the roof to receive, to deflect and to disperse streams of run-off water flowing downwardly from the roof.

Roof water disperser systems of the type disclosed in U.S. Pat. Nos. 3,939,616 and 4,646,488 are intended to replace conventional rain gutters. As more fully discussed in these patents, rain gutters are generally expensive to install, require continuous maintainance to remove leaves and other debris which accumulate in the channels, and divert roof run-off water into relatively large streams which impact against the same area or areas of the underlying terrain with a damaging and errosive effect. Roof water dispersal systems employing parallel slats, such as those disclosed in U.S. Pat. Nos. 3,939,616 and 4,646,488, are easy to install and require minimal maintainance subsequent to installation. More importantly, run-off roof water is dispersed by the multiple-slat assembly over a wide range of terrain extending along the entire roof edge, thereby avoiding any damaging and errosive effect on the underlying terrain which would otherwise result from the impact of high velocity streams of unimpeded run-off water continuously against the same localized areas beneath the roof edge.

U.S. Pat. Nos. 5,261,195 and 5,261,196 disclose and claim improvements to the prior art roof water dispersal systems of the type exemplified by the aforementioned U.S. Pat. Nos. 3,939,616 and 4,646,488. The disclosures of U.S. Pat. Nos. 5,261,195 and 5,261,196 are directed to roof water dispersal systems which provide optimum dispersion characteristics by, among other things, varying the thickness, shape and material from which the lateral extending dispersal elements or slats in the overall dispersal assembly are formed; varying the direction of roof water flow from the drip edge relative to the dispersal assembly; and varying the angular orientation of the overall assembled roof water dispersal element relative to the horizontal. As noted above, the disclosures of U.S. Pat. Nos. 5,261,195 and 5,261,196 are expressly incorporated by reference in the present specification and attention is directed to the two patents for further information concerning the improvements to roof water dispersal systems disclosed therein.

The present invention provides further improvements to the prior art roof water dispersal systems exemplified by U.S. Pat. Nos. 3,939,616 and 4,646,488. The present invention is also directed to additions and modifications to the roof water dispersal systems disclosed and claimed in applicants' earlier U.S. Pat. Nos. 5,261,195 and 5,261,196. As is discussed in greater detail below, the transverse or perpendicularly oriented cross members of the known roof water dispersal systems, including supporting brackets, are oriented to support the laterally extending dispersal elements from below. In accordance with a first aspect of the present invention, the transverse supporting and spacing elements are oriented and arranged to support the laterally extending dispersal elements from above, and not below. In a further aspect of the present invention, barrier elements are mounted at predetermined spaced distances along the length of each of the laterally extending disperser elements for inhibiting lateral flow of roof water received by the disperser element. Other advantages of the improvements to roof water dispersal systems in accordance with the present invention will be apparent from the following description in conjunction with the drawings.

SUMMARY OF THE INVENTION

A roof run-off water dispersal system includes a plurality of longitudinally extending lateral dispersal elements or slats oriented substantially parallel to a drip edge of a roof structure, and mounted relative to the roof structure to receive streams of run-off water therefrom. The dispersal elements are supported and maintained at a predetermined spacing relative to each other, and at a predetermined angle of inclination relative to the horizontal, by one or more transverse or cross members intersecting the lateral slats in a substantially perpendicular direction. The assembly comprising the dispersal elements and transverse members is mounted relative to the drip edge of a structure for receiving run-off water flowing from the roof of the structure, and for dispersing the water over a wide range of terrain beneath the drip edge of the roof. Roof water dispersal systems in accordance with the present invention replace conventional rain gutters, and eliminate the errosive effect on the terrain beneath the roof structure which are generally associated with rain gutters, as discussed above.

In accordance with a first aspect of the present invention, the transversely oriented cross members, including supporting bracket means, are mounted to the top of the laterally extending dispersal elements, and not below the dispersal elements as in the known roof water dispersal systems. In this manner, concentration or accumulation of water on the lateral disperser elements at areas of intersection between the lateral dispersal elements and the transverse supporting elements as a result of lateral flow of the water along the disperser elements, is significantly reduced. Accordingly, dripping of accumulated water at the points of intersection of the lateral and the transverse elements is reduced, thereby reducing the concentration of dripping water and the resulting corrosive effect thereof on the localized areas of terrain directly beneath the points of intersection of the lateral and transverse elements of the assembled roof water dispersal system.

In a further aspect of the present invention, lateral flow of water along a disperser element is controlled by barrier elements at predetermined spaced distances along each of the lateral dispersal elements. In this manner, lateral flow of water along each dispersal element is impeded to further prevent accumulation of water at any localized areas on said lateral elements for promoting the uniform dispersion of water from the dispersal elements. The lateral barrier element will either disrupt any lateral flow of water along the dispersal element at predetermined positions along said element, or impede the flow and reduce the velocity thereof, depending upon the velocity and volume of water flowing laterally along the disperser element, and the flow of water from the drip edge of the roof onto the disperser assembly. Preferably, each lateral barrier element is oriented in a plane which is substantially perpendicular to the longitudinal axis of the dispersal element on which it is mounted.

An additional advantage of a roof water dispersal system in which the dispersal elements are supported from the top by the transverse elements is that the lateral dispersal elements may be spaced as closely as desired to the side wall or drip edge of the structure to which the disperser assembly is mounted. A top-supported disperser assembly may, if desired, be mounted to a building structure such that the innermost lateral disperser element is flush against the building surface. Preferably, a predetermined gap or spacing between the building surface and the innermost disperser element will be provided to avoid accumulation or entrapment of water between the inner edge of the disperser assembly and the building structure to which it is mounted. Providing the assembled disperser unit with an overhead support enables the installation of the disperser unit on a building structure in a manner which permits the control and selection of the spacing between the innermost lateral dispersal element and the building structure in a more precise manner than is possible with the known disperser assemblies which are supported from the bottom and therefore practically require a minimum gap spacing between the innermost disperser element and the building structure for mounting purposes.

In accordance with the present invention, the dispersal elements, the supporting transverse spacer members including bracket means, and the lateral barriers or fins mounted to the dispersal elements, can be fabricated from any known materials, including those discussed in the aforementioned patents. Preferably, the elements of the roof water dispersal systems in accordance with the present invention will be formed from injection molded plastic to facilitate the manufacturing process. As is also discussed in greater detail below, the laterally extending disperser elements can be mounted to tabs extending from the overhead transverse supporting and spacing elements (including bracket means) by orbital riveting, or other known means disclosed in the prior art, and in particular the mounting means disclosed in U.S. Pat. No. 4,646,488.

As is also discussed in greater detail below, the improvements provided by the present invention can be combined with one or more features of the roof water dispersal systems disclosed in Applicants' aforementioned U.S. Pat. Nos. 5,261,195 and 5,261,196. The advantages and improvements of roof water dispersal systems in accordance with the present invention will be apparent to those skilled in the art from the following detailed discussion and the drawings illustrating the same.

DESCRIPTION OF THE BEST MODES FOR CARRYING OUT THE INVENTION

Figure 1:
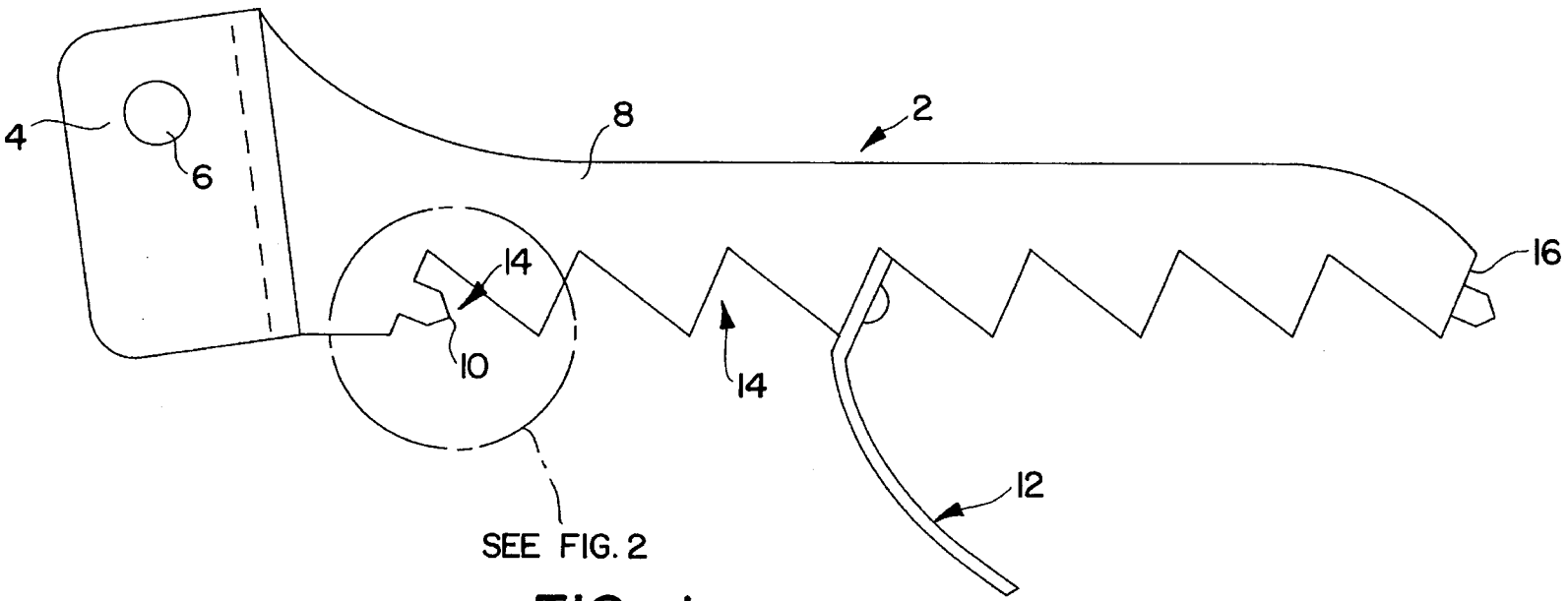
FIG. 1 of the drawing illustrates a side elevational view of an overhead supporting and spacing element for a roof water dispersal system in accordance with the improvements of the present invention, showing one lateral disperser element mounted to the overhead supporting and spacer element and means for mounting the lateral element thereto.

FIGS. 1–5 of the drawing illustrate the best modes for carrying out the improvements to roof water dispersal systems in accordance with the present invention. The disclosures of U.S. Pat. Nos. 3,939,616; 4,646,488; 5,261,195; and 5,261,196, are expressly incorporated by reference in the present specification.

FIG. 1 of the drawing illustrates an overhead or top-oriented support end spacer transverse element for the roof water dispersal systems of the present invention. The transverse element, generally designated by reference numeral 2, includes a rearwardly oriented mounting portion designated generally by reference numeral 4 defining therein a mounting opening generally designated by the reference numeral 6. A forward portion of the transverse element 2, generally designated by the reference numeral 8, includes means for supporting laterally extending disperser elements 12 from above, and for maintaining the laterally extending disperser elements 12 spaced a predetermined distance apart from each other. A tab designated by reference numeral 10 extends from each of a plurality of cutout portions 14 defined in the bottom surface of the forward portion 8 of the overhead transverse element. The laterally extending disperser elements 12 are mounted to the tab 10 in accordance with known methods, such as those disclosed in U.S. Pat. No. 4,646,488. As is also known from the disclosures of the aforementioned patents incorporated by reference herein, the transverse element 2 extends in a direction which is substantially perpendicular to the lateral disperser elements which extend longitudinally and substantially parallel to the drip edge of the roof of the structure to which the roof water dispersal system is mounted. The transverse elements, which can include bracket means, intersect with and support the disperser elements in a predetermined position and orientation relative to the structure to which the disperser assembly is mounted, and maintain a predetermined spacing between each of the separate lateral disperser elements comprising the disperser assembly. The general orientation of the transverse elements and the lateral elements, the general orientation of the assembled disperser unit and the structure to which it is mounted, and the known means for mounting the disperser elements to the transverse elements, are disclosed and illustrated in the aforementioned patents which are incorporated by reference herein, and therefore will not be expressly discussed in detail in the present specification.

Figure 2:
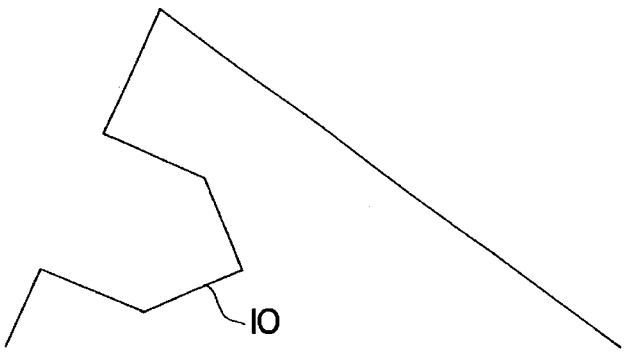
FIG. 2 illustrates a tab element of the transverse overhead support and spacer element for mounting a lateral disperser element thereto, as illustrated in FIG. 1.

FIG. 2 of the drawing illustrates the tab 10 extending into one of the cutout portions 14 defined in the bottom surface of the forward portion 8 of the transverse element 2. In the embodiment of the invention illustrated by FIG. 1, the forward portion 8 of the transverse element 2 defines eight different tabs, seven of which extend into the seven cutout portions 14 defined in the bottom surface of the forward portion 8, and one tab which extends forwardly from the front surface 16 of the forward portion 8 of the transverse element. In this manner, the transverse element 2 supports eight separate longitudinally extending lateral disperser elements 12 from the top of each of the disperser elements. Preferably, as more fully disclosed in U.S. Pat. No. 4,646,488, the tabs 10 are integrally formed with the transverse element 2, and each of the longitudinally extending disperser elements 12 is orbitally riveted to a separate tab 10.

Figure 3:
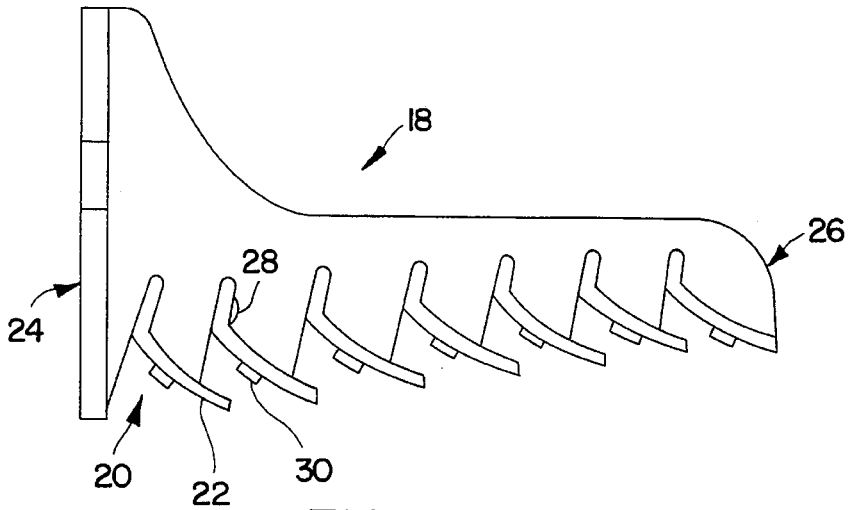
FIG. 3 illustrates an alternative configuration of an overhead transverse support and spacer bracket element for a roof water dispersal system in accordance with the present invention.

FIG. 3 illustrates an alternative embodiment of a top-oriented transverse element (or bracket) for supporting and spacing the longitudinally extending lateral disperser elements in accordance with the rain disperser assembly of the present invention. The transverse element, generally designated by reference numeral 18, defines a plurality of cutout portions 20 in the bottom surface thereof. A longitudinally oriented disperser element 22 extends outwardly from each of the cutout portions 20 in a direction from the rear surface 24 of the transverse element 18 towards the front surface 26 of the transverse element 18. In the embodiment illustrated by FIG. 3, each of the longitudinally extending disperser elements 22 is mounted in one of the cutout portions 20 in the bottom surface of the transverse element 18, and is attached to the bottom surface of the transverse element 18 at two separate mounting points designated by reference numerals 28 and 30. Accordingly, the bracket or transverse supporting and spacer element 18 provides both overhead support for the disperser element 22 and also provides two-point mounting to more securely assemble the roof water dispersal unit.

The provision of overhead bracket or support means for the longitudinally extending disperser element of the roof water dispersal system in accordance with the present invention is advantageous in several different respects. The transverse supporting and spacer elements (cross-spacers) of the known roof water dispersal systems, which provide support to the longitudinally extending disperser elements from only the bottom, tend to create concentrated drip areas beneath the assembled roof water dispersal units. Surface tension results in the concentration of water at the locations at which the transverse elements or transversely oriented brackets intersect the bottom surfaces of the lateral extending disperser elements, resulting in dripping of the concentration of roof water from the roof water dispersal unit at the same separate points of intersection of the transverse and longitudinally extending elements. As a result, a higher concentration of water drips down on the same localized areas of terrain beneath the points of intersection on the roof water dispersal unit, resulting in a higher corrosive effect on the terrain directly therebelow, and decreasing the overall dispersion efficiency of the assembled disperser unit.

The effect described above results from run-off roof water which is received by the disperser assembly proximate to the point of intersection of the lateral and transverse elements. The concentration of water at the points of intersection of the transverse and lateral elements is also increased as a result of surface tension which results in lateral transfer or flow of run-off roof water received by the lateral disperser elements of the dispersal assembly, even at locations not proximate to the intersection of the disperser elements and the transverse elements. Run-off water is carried along the laterally extending disperser elements as a result of surface tension until the lateral flow of water is impeded or obstructed by a transverse element intersecting the lateral disperser element from below. The interference or obstruction with the lateral flow of water along the disperser element by the bottom supported, downwardly extending transverse element, results in a further concentration of water dripping downwardly from the points of intersection of the lateral disperser elements and the downwardly extending transverse elements, causing a higher concentration of water to drip and corrode the terrain at the same localized areas directly beneath the points of intersection.

A primary object of the present invention is to provide a roof water dispersal system which eliminates or reduces the concentration and dripping of water from the disperser unit at predetermined positions, particularly from the areas at which the lateral end transverse elements intersect. This object is accomplished by providing the lateral disperser elements with transverse elements or bracket means which support the lateral elements from the top, and not the bottom. In this manner, run-off roof water received by or on the upwardly oriented transverse elements is uniformly dispersed by the lower oriented laterally extending disperser elements, reducing or eliminating concentration of water at the location of the intersecting transverse elements, thereby reducing the concentration of water dripping vertically downwardly from the transverse elements. By orienting the transverse elements to support the dispersal elements from above, any water which would otherwise be concentrated at the transverse elements, either as a result of run-off water being directly received on the transverse elements or as a result of the lateral flow of water along the disperser elements, will not drip directly vertically downwardly onto the terrain below, but will drip randomly onto the laterally extending disperser elements oriented below the transverse elements for uniform dispersion of the water, thereby reducing the concentration and vertical dripping of water from the same localized areas of the disperser assembly. Additionally, by orienting the transverse elements above the laterally extending disperser elements, it is less likely that the transverse elements will significantly impede or obstruct lateral flow of water along the disperser elements, thereby reducing the likelihood that laterally flowing water will concentrate and drip from the areas at which the transverse elements intersect the lateral disperser elements.

The overhead orientation of the transverse element in the roof water dispersal system is also advantageous in that it enables the overall assembled disperser unit to be mounted as close to a building structure as is desired by the user. In disperser assemblies in which the transverse elements support the dispersal elements from below, a minimum spacing between the innermost lateral disperser element and the surface of the building structure is required to permit the assembled disperser unit to be mounted to the building structure. In the disperser units in accordance with the present invention, the use of transverse elements or supporting brackets which are mounted to the top of the laterally extending disperser elements eliminates any minimum spacing requirement between the innermost lateral disperser element and the building structure. This occurs because the disperser elements extending downwardly from the transverse supporting elements can be positioned as close to the building structure as desired since no portion of the transverse element is disposed between the rear surface of the innermost lateral disperser and the outer surface of the building structure to which the disperser unit is mounted. Accordingly, if desired, the innermost lateral disperser element can be oriented to abut directly against the building surface, or to be spaced away from the building surface any desired distance. Unlike the known roof water dispersal units in which the transverse elements support the lateral disperser elements from below, no minimum spacing between the innermost disperser element and the building surface is generally required by the top supported disperser units in accordance with the present invention for mounting purposes. Preferably, the innermost lateral disperser element of the assembled disperser unit will be spaced approximately ⅛th of an inch from the surface of the structure to which the unit is mounted. In this manner, a minimal gap is provided to avoid entrapment of water between the building structure and the disperser unit. On the contrary, a bottom supported roof dispersal unit generally requires at least a ½ inch spacing between the building surface and the innermost lateral disperser element as a result of mounting requirements. By minimizing the gap between the lateral disperser elements and the building structure, the overhead supported disperser units in accordance with the present invention are adapted for mounting to a much broader range of building configurations without modifying the disperser system. Additionally, by minimizing the gap between the innermost lateral disperser element and the building surface, the possibility of run-off roof water dripping behind the disperser unit and not being uniformly dispersed by the assembled unit is reduced, thereby increasing the dispersion efficiency of the overall assembled disperser unit.

Figure 4:
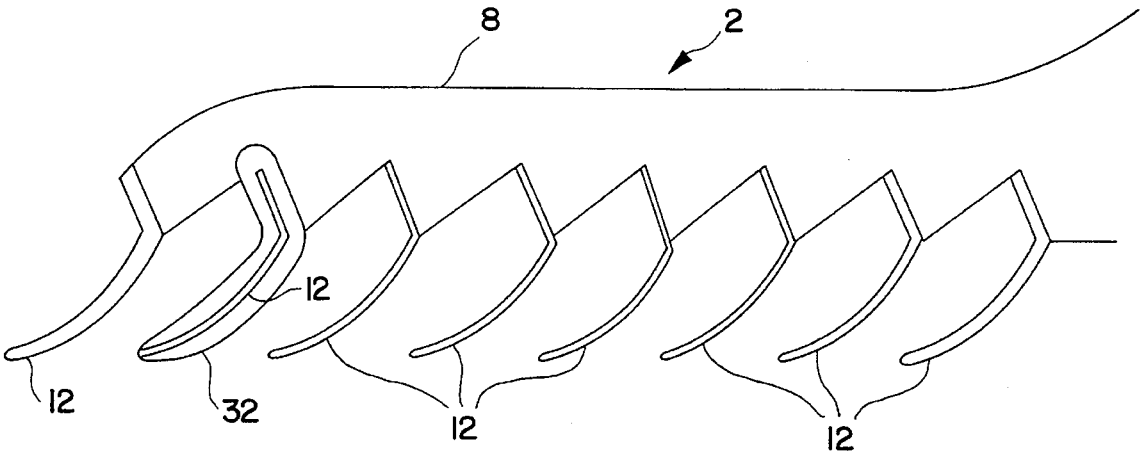
FIG. 4 illustrates a side elevational view of a lateral barrier element mounted to a lateral disperser element which itself is mounted to an overhead transverse support and spacer element of a roof water dispersal system in accordance with the present invention.
Figure 5:
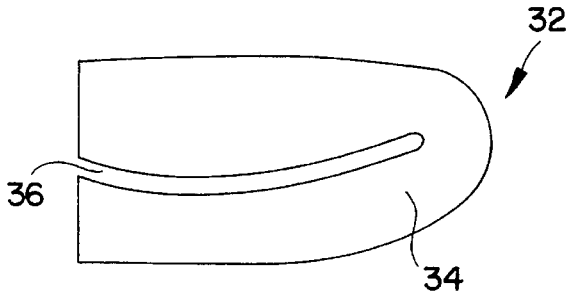
FIG. 5 illustrates a side elevational view of the lateral barrier element illustrated in FIG. 4 but removed from the lateral disperser element of the roof water dispersal system in accordance with the present invention.

FIGS. 4 and 5 illustrate a further aspect of the improvement to roof water dispersal systems in accordance with the present invention. FIG. 4 illustrates the front portion 8 of the transverse element 2, illustrated by FIG. 1, in which a plurality of laterally extending disperser elements 12 are supported from above by the transverse element. A lateral barrier or fin 32 is shown projecting from one of the disperser elements 12. In the preferred embodiments of the invention, a plurality of lateral barriers 32 are mounted to or integrally defined on each of the lateral disperser elements 12, and are spaced a predetermined distance from each other along the entire longitudinal length of each disperser element. Preferably, each lateral barrier is spaced ½ inch apart from an adjacent lateral barrier along the entire length of each disperser element 12. In the preferred embodiment of the invention, each lateral barrier is approximately 0.125 inches wide in cross section, is approximately 20 mils in thickness, and is tapered in a direction from its top to its bottom. Each lateral barrier 32 extends along a plane which is substantially perpendicular to the plane of longitudinal extension of the disperser element 12 to which the lateral barrier is mounted, and thus defines a fin-like structure at selected locations along the laterally extending disperser element 12. As illustrated by FIG. 4 of the drawing, the general cross sectional configuration of the lateral barrier 32 substantially conforms to the cross sectional configuration of the disperser element 12.

The lateral barriers 32 may be formed from any suitable material, including lightweight metal such as aluminum or plastic. Preferably, the lateral barriers will be formed from plastic to facilitate the fabrication process by injection molding.

FIG. 5 illustrates a side elevational view of a single lateral barrier 32 as illustrated in FIG. 4, removed from the disperser element 12. The lateral barrier includes a main body portion 34, which as discussed above is preferably tapered at its forward or lower end, and a generally centrally disposed channel 36 for receiving a lateral disperser element 12 for mounting the lateral barrier to the disperser element as illustrated in FIG. 4. Although the lateral barriers illustrated in the drawing are substantially planar in nature to form a fin-like structure mounted to the lateral disperser elements, other configurations for this element are within the scope of the present invention. For example, the lateral barrier elements can be conical in shape and formed as plastic "nose-cones" which are tapered at the lower forward ends thereof.

In operation, the lateral barriers 34 interrupt or impede the phenomenon of lateral transfer discussed above by providing an obstacle to the lateral flow of run-off roof water along the longitudinally extending disperser elements. Preferably the lateral barriers 34 are spaced a predetermined distance apart from each other along the entire longitudinal length of the disperser elements. It is currently believed that the appropriate spacing between adjacent lateral barrier elements is substantially ½ inch. The lateral barriers are oriented along a plane which is substantially perpendicular to the longitudinal axis through which the disperser elements extend so that the lateral barriers effectively provide transversely oriented obstruction means or "speed bumps" extending from both the upper and lower surfaces of each of the lateral disperser elements. It is contemplated that the lateral barrier elements 34 spaced along the longitudinally extending disperser elements of a roof water dispersal system improve dispersal performance at low rainfall rates, and may also enhance the overall dispersion efficiency of the disperser unit. The improvement to the dispersion efficiency is believed to result directly from the reduction of lateral transfer of run-off roof water flowing along the disperser element as a result of the interspaced lateral transfer barrier elements mounted thereon. The phenomenon of lateral transfer is believed to be detrimental to the dispersion efficiency of the disperser unit, at least at low rates of rainfall.

The improvements of the present invention may be combined with the improvements to roof water dispersal systems disclosed in U.S. Pat. Nos. 5,261,195 and 5,261,196. As noted above, the aforementioned patents, inter alia, are directed to improvements to the dispersion efficiency of roof-water dispersal systems by varying the thickness, configuration and materials from which the disperser elements are formed, and varying the angular orientation of the disperser unit relative to the drip edge of a structure to which the disperser unit is mounted. Further improvements to roof water dispersal systems are also disclosed in the two earlier patents. The modifications and improvements disclosed in U.S. Pat. Nos. 5,261,195 and 5,261,196 can be combined with the improvements to roof-water dispersal systems of the present invention to include the feature by which the transverse elements and/or bracket means are oriented to support the lateral disperser elements from the top, and not the bottom, thereby providing the disperser units disclosed in the earlier patents with the advantages of the top-support feature as disclosed in the present specification. Additionally, the improved roof-water dispersal systems as disclosed in the aforementioned two earlier patents can also include the lateral barrier elements mounted along the lateral disperser elements in accordance with the present invention to result in roof-water dispersal systems exhibiting the advantages of both the aforementioned two patents and the improvements of the present invention resulting from the reduction and control of the phenomenon of lateral transfer. As also discussed herein, the improved roof-water dispersal systems of U.S. Pat. Nos. 5,261,195 and 5,261,196, when provided with transverse elements to support the disperser element from the top, result in roof-water dispersal systems in which the gap between the innermost lateral disperser element and the surface of the structure to which the disperser unit is mounted, can be of any desired spacing and does not require a minimum spacing for mounting purposes as in the case of a disperser unit supported by transverse elements from the bottom.

Other features and advantages of the improvements to roof water dispersal systems in accordance with the present invention will become apparent to those skilled in the art. Accordingly, the description of the preferred embodiments of the invention herein is intended to be illustrative only, and not restrictive of the scope of the invention, that scope defined by the following claims and all equivalents thereto.

We claim:

1. A roof water dispersal system comprising a plurality of longitudinally extending dispersal elements adapted to being oriented at a predetermined position relative to a drip edge of a roof structure, and at least one transverse element intersecting said plurality of dispersal elements at a substantially perpendicular angular orientation relative thereto, said at least one transverse element being oriented above said plurality of dispersal elements for providing said dispersal elements with overhead support.

2. The roof water dispersal system as claimed in claim 1 wherein said plurality of dispersal elements each have top portions which are mounted to said at least one transverse element, each of said plurality of dispersal elements having bottom portions extending from a bottom surface of said at least one transverse element.

3. The roof water dispersal system as claimed in claim 1 further including a plurality of said transverse elements oriented above said plurality of longitudinally extending dispersal elements.

4. The roof water dispersal system as claimed in claim 2 wherein said at least one transverse element includes a plurality of cutouts defined on the bottom surface thereof, each of said longitudinally disperser elements being mounted to the bottom surface of said at least one transverse element in a different one of said cutouts.

5. The roof water dispersal system as claimed in claim 1 wherein at least one of said plurality of dispersal elements is of a variable thickness in cross section.

6. The roof water dispersal system as claimed in claim 1 wherein at least one of said dispersal elements is different in cross sectional configuration from at least another one of said dispersal elements.

7. The roof water dispersal system as claimed in claim 1 wherein at least one of said dispersal elements is of a cross sectional thickness which is different from the cross sectional thickness of at least another one of said dispersal elements.

8. The roof water dispersal system as claimed in claim 1 wherein at least one of said dispersal elements is at least partially curved in cross sectional configuration and at least another one of said dispersal elements includes at least a first straight portion.

9. The roof water dispersal system as claimed in claim 1 wherein at least one of said dispersal elements is formed from a material which is different from at least another one of said dispersal elements.

10. The roof water dispersal system as claimed in claim 1 further including at least one barrier element on at least one of said longitudinally extending dispersal elements.

11. The roof water dispersal system as claimed in claim 10 wherein said at least one barrier element is oriented in a plane substantially perpendicular to the longitudinal axis of said at least one lateral dispersal element to which said at least one barrier element is mounted.

12. The roof water dispersal system as claimed in claim 11 further including a plurality of said barrier elements on each of said longitudinally extending dispersal elements, each of said barrier elements spaced a predetermined distance apart from an adjacent barrier element on each of said dispersal elements.

13. The roof water dispersal system as claimed in claim 11 wherein said at least one barrier element is planar and forms a fin-like element extending from the upper and lower surfaces of said at least one dispersal element from which said at least one barrier element extends.

14. The roof water dispersal system as claimed in claim 11 wherein said at least one barrier element is tapered inwardly at the lower portion thereof.

15. The roof water dispersal system as claimed in claim 1 wherein said at least one transverse element comprises a supporting bracket.

16. A roof water dispersal system comprising a plurality of longitudinally extending dispersal elements, and means for mounting said plurality of dispersal elements relative to a drip edge of a roof structure to receive and disperse water flowing from said roof structure, at least one of said dispersal elements including at least one barrier element thereon, said barrier element being oriented in a plane substantially perpendicular relative to the longitudinal axis of said at least one dispersal element, said barrier element impeding the lateral flow of water along said at least one dispersal element to which said at least barrier element is mounted.

17. The roof water dispersal system as claimed in claim 16 further including at least one of said barrier elements on each of said plurality of dispersal elements for impeding the lateral flow of water along each of said plurality of dispersal elements of said roof water dispersal system.

18. The roof water dispersal system as claimed in claim 16 further including at least one transverse element intersecting said plurality of longitudinally extending dispersal elements at a substantially perpendicular angle relative thereto, said at least one transverse element being oriented above said plurality of dispersal elements and being mounted to said plurality of dispersal elements for providing overhead support thereto.

19. The roof water dispersal system as claimed in claim 17 further including a plurality of said barrier elements mounted to each of said plurality of disperser elements, said plurality of barrier elements being spaced a predetermined distance apart from each other on each of said disperser elements.

20. A roof water dispersal system comprising a plurality of longitudinally extending dispersal elements adapted to be mounted relative to a drip edge of a roof of a building structure for receiving water flowing from said roof, at least one of said dispersal elements being an innermost dispersal element and located closer to said structure than the other of said dispersal elements, said roof water dispersal system further including at least one transverse element intersecting said plurality of dispersal elements at a substantially perpendicular angle relative thereto, said at least one transverse element being oriented above said plurality of disperser elements for providing overhead support to said plurality of disperser elements, said at least one transverse element including means for mounting said roof water dispersal system relative to said drip edge of said roof such that the distance between said innermost dispersal element and said structure to which said roof water dispersal system is mounted is selectively variable in a range between zero spacing (in which said innermost dispersal element is contiguous with said structure) and a predetermined spacing greater than zero.

* * * * *